US009611637B2

(12) United States Patent
Dynon

(10) Patent No.: US 9,611,637 B2
(45) Date of Patent: Apr. 4, 2017

(54) PREFABRICATED FOLDABLE BUILDING MODULE

(71) Applicant: Matthew Dynon, Sydney (AU)

(72) Inventor: Matthew Dynon, Sydney (AU)

( * ) Notice: Subject to any disclaimer, the term of this patent is extended or adjusted under 35 U.S.C. 154(b) by 0 days.

(21) Appl. No.: 14/783,883

(22) PCT Filed: Apr. 3, 2014

(86) PCT No.: PCT/AU2014/000359
§ 371 (c)(1),
(2) Date: Oct. 12, 2015

(87) PCT Pub. No.: WO2014/169320
PCT Pub. Date: Oct. 23, 2014

(65) Prior Publication Data

US 2016/0069062 A1 Mar. 10, 2016

(30) Foreign Application Priority Data

Apr. 15, 2013 (AU) ..... 2013901303

(51) Int. Cl.
*E04B 1/344* (2006.01)
*E04B 1/348* (2006.01)
(Continued)

(52) U.S. Cl.
CPC ..... *E04B 1/3442* (2013.01); *E04B 1/3444* (2013.01); *E04B 1/34336* (2013.01);
(Continued)

(58) Field of Classification Search
CPC ..... E04B 1/34357; E04B 1/34384; E04B 1/34815; E04B 1/3445; E04B 1/344;
(Continued)

(56) References Cited

U.S. PATENT DOCUMENTS 2,395,691 A 2/1946 Smith
2,469,840 A * 5/1949 Orth ..... E04D 13/1415 52/60

(Continued)

FOREIGN PATENT DOCUMENTS

JP 2003138685 A * 5/2003
WO 2012126066 9/2012

OTHER PUBLICATIONS

Machine translation of JP 2003138685 A obtained from https://www4.j-platpat.inpit.go.jp/cgi-bin/tran_web_cgi_ejje?u=http://www4.j-platpat.inpit.go.jp/eng/translation/2016012304544315527191687077964058FF1278800925CD5A42FCD19B7A9D9D8A, viewed on Jan. 25, 2016.*

(Continued)

*Primary Examiner* — Theodore Adamos
(74) *Attorney, Agent, or Firm* — Rankin, Hill & Clark LLP

(57) ABSTRACT

A prefabricated foldable building module including a central core comprising first and second opposing fixed walls with roof and floor beams interposed therebetween; a plurality of vertically foldably connected walls mounted upon the first and second walls foldable out therefrom; a pair of roof panels, each foldably connected adjacent said roof beam; a pair of floor panels each foldably connected adjacent floor beam: characterized in that the wall panels, roof panels and floor panels may be folded out from their supporting structures in a defined sequence to form an enclosed/partly enclosed building structure, and may be re-folded in reverse sequence to original configuration. Standard modules can be stretched, or joined side by side, end to end or one on top of the other to form larger buildings.

21 Claims, 4 Drawing Sheets

(51) Int. Cl.

| | |
|---|---|
| ***E04B 1/343*** | (2006.01) |
| *E04H 1/02* | (2006.01) |
| *E04H 1/06* | (2006.01) |
| *E04H 1/12* | (2006.01) |
| *E04H 3/08* | (2006.01) |
| *E04H 3/16* | (2006.01) |
| *E04H 5/02* | (2006.01) |

(52) U.S. Cl.
CPC ..... *E04B 1/34357* (2013.01); *E04B 1/34384* (2013.01); *E04B 1/34815* (2013.01); *E04H 1/02* (2013.01); *E04H 1/06* (2013.01); *E04H 1/12* (2013.01); *E04H 3/08* (2013.01); *E04H 3/165* (2013.01); *E04H 5/02* (2013.01)

(58) Field of Classification Search
CPC ..... E04B 1/34378; E04B 2001/34389; E04B 1/3442; E04B 1/343364; E04H 2001/1283; E04H 1/02; E04H 1/06; E04H 1/12; E04H 3/08; E04H 3/165; E04H 5/02
USPC .... 52/65, 68, 69, 70, 71, 79.1, 79.5, 79.275, 52/276, 278, 279, 281, 282.1, 282.3, 283, 52/287.1, 288.19, 288.1
See application file for complete search history.

(56) References Cited

U.S. PATENT DOCUMENTS 3,410,038 A * 11/1968 Gobel ..... E04D 13/1415 52/273
3,719,010 A * 3/1973 Hickman ..... E04D 13/155 52/60
3,979,860 A * 9/1976 Roth ..... E04D 13/1415 52/302.1
4,288,951 A * 9/1981 Carlson ..... E04D 13/1606 52/262
4,528,784 A * 7/1985 Simpson ..... E04D 13/0648 52/14
4,534,141 A * 8/1985 Fagnoni ..... E04B 1/3444 52/126.1
4,545,158 A * 10/1985 Rizk ..... E04B 1/3483 52/238.1
4,546,578 A * 10/1985 Behrmann ..... E04B 1/344 296/172
5,966,956 A * 10/1999 Morris ..... F25D 11/003 52/69
6,983,567 B2 1/2006 Ciotti
7,841,136 B2 * 11/2010 Czyznikiewicz ..... E04B 1/3444 52/64
8,286,391 B2 10/2012 Yang et al.
8,474,194 B2 * 7/2013 Tiramani ..... E04B 1/3442 52/270
8,650,806 B1 * 2/2014 Condie ..... E04H 1/1205 52/79.5
2002/0116878 A1 * 8/2002 Ciotti ..... E04B 1/3442 52/64
2002/0178671 A1 * 12/2002 Gembala ..... E04D 3/405 52/302.6
2004/0194396 A1 10/2004 Shanni
2005/0066589 A1 * 3/2005 Bedell ..... E04H 9/14 52/79.1
2009/0044460 A1 * 2/2009 Medley ..... E04B 1/3444 52/71
2010/0064599 A1 * 3/2010 Yang ..... E04B 1/3444 52/79.5
2010/0269419 A1 * 10/2010 Gyory ..... E04B 1/3444 52/79.5
2011/0259768 A1 * 10/2011 Campbell ..... E04B 1/3444 206/216
2013/0305628 A1 * 11/2013 Warner ..... E04B 1/34357 52/79.5
2014/0033619 A1 * 2/2014 Merchant ..... E04B 1/34357 52/71
2014/0144088 A1 * 5/2014 Heger ..... E04B 1/34357 52/79.5

OTHER PUBLICATIONS

International Search Report of PCT/AU2014/000359 dated May 27, 2014 6 pages.

* cited by examiner

PREFABRICATED FOLDABLE BUILDING MODULE

TECHNICAL FIELD

The present invention relates to prefabricated budding modules and particularly those of a hinged, fold out configuration to facilitate relatively quick deployment and erection, compact storage, efficient transport and relocation.

BACKGROUND

Prefabricated foldable structures already exist and provide useful accommodation for permanent occupation and also for temporary workforces involved in mining, farming, construction and re-construction in remote areas. Foldable buildings are designed to meet the requirements of efficient transport, storage and erection, re-transport and reuse. Such designs fold out in a variety of different ways after arriving on site. Many however, rely on mechanical opening devices such as wheel and track systems while others require a crane to lift components into place. In most cases the roof element needs to be temporarily supported while other elements are secured in place.

The demand for prefabricated structures suited for easy and quick deployment is increasing for a number of reasons, e.g. the frequency of natural disasters has led to an increased need for both emergency housing and shelters for the provision of medical and other services to victims.

An affordability problem exists for housing and other building provision in regional and remote areas where lack of skilled trades and expensive goods delivery charges inflate the cost. Manufacture of buildings or building elements in the factory to a substantially complete form ready for connection to services and use on a particular site is known and goes some way towards addressing this problem. However, it is often not practical, feasible or economic to transport these buildings or building elements due to their large physical size.

SUMMARY

In accordance with a first aspect there is provided, a standard prefabricated foldable building module having a central core comprising first and second opposing fixed walls with two roof beams and two floor beams interposed between said walls adjacent the top and bottom respectively, a central roof portion associated with and parallel to the roof beams, a central floor portion associated with and parallel to the floor beams; a plurality of vertically foldably connected walls mounted upon each of the first and second walls foldable out therefrom; a pair of roof panels, one foldably connected adjacent each of the roof beams; a pair of floor panels, one foldably connected adjacent each of the floor beams, characterized in that the foldably connected wall panels and floor panels may be folded out from their supporting structures so as to form an enclosed structure with the roof panels foldable upwardly and outwardly in a configuration permitting the outer foldable walls to directly or indirectly support their outer edges and such that there is fall from such outer edges back to the central roof portion; the foldable walls, floor and roof prior to erection lying substantially co-planar to each other so as to occupy minimal space during transport and storage.

In accordance with a second aspect there is provided, a more basic prefabricated foldable building module having a narrower central core comprising first and second opposing fixed walls with one roof beam and one floor beam interposed between said walls, adjacent the top and bottom respectively; a plurality of vertically foldably connected walls mounted upon each of the first and second walls foldable out therefrom; a pair of roof panels, one foldably connected adjacent each side of the roof beam; a pair of floor panels, one foldably connected adjacent each side of the floor beam, characterized in that the foldably connected wall panels and floor panels may be folded out from their supporting structures so as to form a structure, either enclosed or partly enclosed, with the roof panels foldable upwardly and outwardly in a configuration permitting the outer foldable walls to directly or indirectly support their outer edges and such that the folding roof panels at all times lie inboard of the walls; the shape of the roof, whether horizontal, gable or butterfly, dependent on the arc of swing of the roof panels. The foldable walls, floor and roof prior to erection lie substantially co-planar to each other so as to occupy minimal space during transport and storage.

In accordance with a third aspect there is provided, a stretched version of the standard prefabricated foldable building module designed for larger buildings in which the central core is stretched, resulting in a longer central floor portion with longer floor beams and a longer central roof portion with longer roof beams. Roof panels and floor panels are stretched laterally to correspond with the longer central core, resulting in a greater sheltered floor space when the module is in open configuration. After the foldable walls are unfolded into open position there remains a gap between the end wall panels on each side of the structure. Additional infill wall panel are placed in the gaps between the end wall panels to complete the perimeter walls. The floor panels and the roof panels are then swung into the open position. While in folded configuration the additional infill wall panels are housed, one on each side of the central core on the outside of the roof panels and the floor panels and in the gap formed between the foldable wall panels.

The opening and closing sequence of the present invention with roof and floor panels folding out within and contained by the foldable walls allows for a greater degree of versatility and flexibility. Additionally, modules in folded configuration present in compact boxlike form and are convenient for storage and transport to site. Components of the module are of a size and weight that allows easy and quick erection, without the necessity for skilled labour or specialized tools. Modules may be deployed rapidly on pre-set foundation supports and are capable of being collapsed to pre-erected configuration after use at any particular location and quickly re-erected and re-used at another location. The design obviates the necessity for eaves and most gutters and lends itself to joining of modules to achieve larger structures or even multi-storey buildings. This invention has particular application to regional and remote areas, as it overcomes to a significant degree, the costs of transport and erection, the need for skilled labour, specialized tools and access to building materials. It is also suitable for temporary housing as well as permanent dwellings, both in urban and non-urban settings.

In an aspect, the arc of swing of the roof panels during the opening sequence of said module can be adjusted to allow a range of different roof slopes and shapes, including horizontal, butterfly and gable configurations.

In another aspect, the dimensions of the elements comprising said module can be so adjusted relative to each other as to enable said module to form a fully enclosed building structure or a partly enclosed building structure, when in its erected configuration.

In another aspect, the roof beam is so configured to incorporate a central roof gutter running along its length, to allow rainwater drainage from the roof panels to discharge on one or both sides of the central core, when the roof is in butterfly configuration.

In another aspect, the foldable building module is characterized by an opening sequence, wherein from its folded configuration, the side wall panels (with the end walls attached) fold out first from the fixed walls moving from a perpendicular to a co-extensive position relative thereto, then the end wall panels fold out from the side wall panels moving from an aligned to a perpendicular position relative thereto, such that their leading edges on each side of the structure are distant by the said gap, then the additional infill wall panels are installed in the gaps between the end wall panels, and then in either order, the roof panels and the floor panels swing out from the roof beams and the floor beams respectively, the roof panels to a position just below and inside the tops of the wall panels, such that there is a fall back from their outer edges to the central roof portion and the floor panels to a position substantially horizontal and co-extensive with the central floor section, whereupon said module attains its erected configuration in the form of an enlarged enclosed building structure.

In another aspect, the foldable building module is characterized by a closing sequence, wherein from its erected configuration the roof panels and the floor panels re-fold first, in either order, the additional infill wall panels are then returned to their housing on either side of the central core, the end panels then fold back against the side wall panels and lastly the side wall panels, in combination with the closed end wall panels, re-fold to their closed position on each side of the central core, whereupon said module reverts to its folded configuration.

In another aspect, the additional infill wall panels can be prefabricated in one complete piece or in a combination of sub-sections that make up the complete piece.

In another aspect, the width of the central core is reduced, such that the central roof portion effectively becomes a box gutter between the two opposing fixed walls of the said central core.

In another aspect, when said module is in its erected configuration, rainwater that falls on the roof panels runs with the slope of the roof panels to the central roof portion, where it is then guided perpendicularly along the said central roof portion to a gutter and downpipe on one or both sides of the central core.

In another aspect, a gutter for catching rainwater is attached along each of the upturned edges of the central roof portion adjacent to the foldably connected edges of the roof panels, such that rainwater runoff from the roof panels flows to the gutters and is then guided in a perpendicular direction to one or both sides of the central core.

In another aspect, in its folded configuration, the foldable walls panels, the roof panels, the floor panels and the additional wall panels (if any), all lie substantially co-planar to each other adjacent the open sides of the central core, such that the said module presents as a compact, box-like structure of rectangular form.

In another aspect, the roof panels and the floor panels swing into erected position after the foldable wall panels have unfolded, such that the roof panels and the floor panels are wholly enclosed within the foldable wall panels, their outer edges supported directly or indirectly by the foldable wall panels.

In another aspect, the roof panels swing into erected position after the foldable wall panels have unfolded, such that the roof panels do not require any additional support whilst the foldable wall panels unfold into their erected position.

In another aspect, said module can be opened to its erected configuration and used at one location, then closed to its folded configuration, transported to another location, and there re-opened to erected configuration and used again.

In another aspect, the process outlined therein can be repeated on multiple occasions.

In another aspect, the tops of the wall panels are higher than the roof height and form a parapet above the roof panels.

In another aspect, the roof panels swing out such that in their fully erected position their leading edges are consistent with the tops of the end wall panels, said roof panels sloping back therefrom towards the roof beam or the central roof core, as the case may be, and wherein the side wall panels are designed such that their top edges are adjacent to and slope at the same angle as the roof panels.

In another aspect, the roof panels are characterized by upturns at their edges that fit into extruded capping sleeves running along the inside top of the wall panels to form a weather proofed detail.

In another aspect, when said module is in its erected configuration, the base of the wall panels sit on foundation supports, either permanent or temporary, providing structural support and integrity to said module and where a variety of foundation systems may be used.

In another aspect, when said module is in its erected configuration, the roof and the floor panels fix to the foldable wall panels to provide structural support for the roof and floor panels and structural integrity to the module as a whole.

In another aspect, wherein window and door openings can be made in any wall and positioned in a multitude of locations.

In another aspect, wherein multiples of said module in the erected configuration may be joined together at any of their four sides to create larger structures in a variety of configurations.

In another aspect, the modules in the erected configuration may be joined together, side by side, either fully interfaced or partly offset, and where corresponding openings may be made at the interface between modules.

In another aspect, multiples of said module in the erected configuration may be joined together, end on end, and where at the interface of one said module with another, the end wall panels of one or both of those modules may be omitted.

In another aspect, the modules in the erected configuration may be joined together, one on top of the other, to form multi-level structures.

In another aspect, the central roof portion and the roof panels of the lower floor module are all brought into horizontal alignment with each other and raised in height to the tops of the walls, such that the roof of the ground floor module presents as a flat surface, and a similar modification applies to intermediate floor modules in a multi-storey structure.

In another aspect, the roof of the lower floor module may be omitted.

In another aspect, the width of the central core is increased to form an expanded central floor portion between the two opening sides, thereby providing additional fixed area for location of bathrooms, kitchens and laundries that require plumbing and electrical wiring and where space permits, for temporary storage of unfixed furniture and building materials whilst said module is in its folded configuration.

In another aspect, said module in its folded configuration is fixed to the tray of a wheeled trailer to create an integrated mobile building module, such that said mobile building module can be easily transported to different locations.

In another aspect, an additional floor panel is horizontally foldably connected to the base of one or each of the two fixed walls of the central core, such that said additional floor panel swings outwards and downwards from a vertically aligned to a substantially perpendicular position relative to the fixed wall and provides external floor area when in the open, horizontal position.

In another aspect, an additional roof panel is horizontally foldably connected to the top of one or each of the two fixed walls of the central core, such that said additional roof panel swings outwards and upwards from a vertically aligned to a substantially perpendicular position relative to the fixed well and provides external roof shelter when in the open, horizontal position.

In another aspect, a volumetric addition is integrally attached to one or both ends of the central core, such that it provides additional volumetric space to the said module.

In another aspect, any one or more of the foldably connected elements comprised in said module are hinged, pin connected or foldably connected in some other way to the structure or element from which they fold out.

In another aspect, following delivery to site and placement of module in its folded configuration on foundation supports, said module may be opened from folded to erected configuration and fixed in position by two able bodied men, with no special tools, other than a simple pulley or winching device, and no special skills, in no more than one day.

In another aspect, said modules have uses that include, but are not limited to, dwelling houses, granny flats, cabanas, pool enclosures, villa units, home units, habitable spaces, shelters, sheds, semi-open enclosures, demountable classrooms, school buildings, offices, factories, relief housing, construction site housing and offices, and mining site housing and offices, caravans and mobile homes.

In another aspect, due to its compact size and maneuverability, said module in its folded configuration, may be stored and moved with relative ease and may be transported on a suitable truck or trailer.

In accordance with a fourth aspect there is provided, a prefabricated, foldable building module, including: a central core, including a central roof portion, a central floor portion and two opposing fixed walls extending between the central roof portion and the central floor portion; a plurality of foldable wall panels including side wall panels each foldably connected to one of the opposing fixed walls and foldable out therefrom and end wall panels each foldably connected to one of the side wall panels and foldable out therefrom; roof panels, each being foldably connected to the central roof portion and foldable out therefrom such that the roof panels swing outwards and upwards on opposite sides of the central core; floor panels, each being foldably connected to the central floor portion and foldable out therefrom such that the floor panels swing outwards and downwards on opposite sides of the central core, wherein the module is moveable between, a folded configuration, in which the foldable wall panels, roof panels and floor panels are stowed at least one of partially within and substantially adjacent the central core, and an erected configuration, in which the wall panels are outwardly folded from the central core such that the side walls extend from the two opposing fixed walls and the end walls extend between the respective side walls, the floor panels are outwardly folded from the central core so as to extend from opposing sides of the central floor portion and the roof panels are outwardly folded from the central core so as to extend from opposing sides of the central roof portion, wherein in the erected condition, the roof portion is recessed relative to tops of the end wall panels and leading edges of the roof panels are positioned inside of and about no higher than the tops of the end wall panels such that the roof panels slope downwardly toward the roof portion.

In an aspect, in the erected condition, the side walls and the end walls are relatively higher than the roof panels so as to form a parapet above the roof panels.

In another aspect, in the erected condition, the leading edges of the roof panels are coupled to the end wall panels below the tops of the end wall panels.

In another aspect, in the erected condition, leading edges of the roof panels are connected by at least one of a pin or clip to the end wall panels just below and inside the tops of the end wall panels.

In another aspect, in the erected condition, foldably connected edges of the roof panels are at least partially elevated relative to the central roof portion so as to direct water captured by the roof panels to the central roof portion.

In another aspect, the roof panels include upturns at edges thereof that fit into extruded capping sleeves running along an inside top of the end wall panels so as to be weather proof.

In another aspect, the central roof portion includes at least one beam.

In another aspect, the central roof portion includes two beams extending along opposing sides of the central roof portion, the roof panels each being connected to a respective one of the two beams.

In another aspect, the central roof portion includes a gutter for directing water captured by the roof panels.

In another aspect, the central roof portion is arranged to direct water toward at least one of the opposing fixed walls of the central core.

In another aspect, a gutter for catching rainwater is attached along upturned edges of the central roof portion adjacent to foldably connected edges of the roof panels, such that rainwater runoff from the roof panels flows to the gutter and is then guided in a direction toward one or both of the fixed walls of the central core.

In another aspect, the roof panels and the floor panels are arranged to swing into the erected configuration after the foldable wall panels have unfolded, such that the roof panels and the floor panels are wholly enclosed within the foldable wall panels, and outer edges of the floor and roof panels are supported directly or indirectly by the foldable wall panels.

In another aspect, the roof panels are arranged to swing into the erected configuration after the foldable wall panels have unfolded, such that the roof panels do not require any additional support whilst the foldable wall panels unfold into the erected configuration.

In another aspect, the end walls present a substantially flush outer surface so as to allow abutment with other modules.

In another aspect, the side walls and ends walls each have substantially flush outer surfaces and uniform parapet heights arranged such that multiples of said module in erected configuration may be joined together at any of their four sides to create larger structures in a variety of configurations.

In another aspect, the side walls and end walls have substantially flush outer surfaces uniform parapet heights uniform parapet heights arranged such that in erected configuration multiples of the module may be joined together, side by side, either fully interfaced or partly offset, and where corresponding openings may be made at the interface between modules.

In another aspect, wherein multiples of said module in erected configuration may be joined together, end on end, either fully interfaced or partly offset, and where at the interface of one said module with another, the end wall panels of one or both of those modules may be omitted.

In another aspect, the parapet is configured to allow multiples of the module to be joined together, one on top of the other, either fully interfaced or partly offset, to form multi-level structures.

In another aspect, an additional floor panel is horizontally foldably connected to the base of one or each of the two fixed walls of the central core, such that said additional floor panel swings outwards and downwards from a vertically aligned to a substantially perpendicular position relative to the fixed wall and provides external floor area when in the open, horizontal position.

In another aspect, an additional roof panel is horizontally foldably connected to a top of one or each of the two fixed was of the central core, such that said additional roof panel swings outwards and upwards from a vertically aligned to a substantially perpendicular position relative to the fixed wall and provides external roof shelter when in an open substantially horizontal position.

In another aspect, the central floor portion includes at least one beam.

In another aspect, in the folded configuration, the foldable walls panels, the roof panels, the floor panels lie substantially co-planar to each other adjacent open sides of the central core such that the module presents as a compact box-like structure.

In another aspect, the prefabricated, foldable building module further includes associated infill panels and wherein in the erected configuration the infill panels are fitted between the end wall panels.

In accordance with a fifth aspect there is provided, a building including one or more of the prefabricated, foldable building module as described above.

In accordance with a sixth aspect there is provided, a method of assembling a building from a prefabricated, foldable building module, the method including the steps of: Folding wall panels outwardly from a central core of the module to form outer walls of the building, the wall panels including side walls foldably connected to fixed walls of the central core and end walls foldably connected to the side walls; Folding floor panels outwardly and downwardly relative to a supporting floor portion of the central core so as to form a floor between the enclosed outer walls of the building; and Folding roof panels outwardly and upwardly relative to a supporting a roof portion supported by the fixed walls of the central core so as to form a roof between the outer walls of the building over the floor, the roof panels being positioned inside of and about no higher than the tops of the end wall panels so as to slope downwardly toward the roof portion.

In an aspect, the method further includes the step of: Securing leading edges of the folding roof panels to inside faces of the end walls by at least one of a clip and pin fitted between the end walls and the folding roof panels.

In accordance with a seventh aspect there is provided, a prefabricated, foldable building module, including: a central core, including first and second opposing fixed walls, with a roof beam and a floor beam interposed between the said fixed walls adjacent the top and bottom respectively; a plurality of foldable walls panels, including four side wall panels each foldably connected to one of the said fixed walls and foldable out therefrom and four end wall panels each foldably connected to one of the side wall panels and foldable out therefrom; a pair of roof panels, one foldably connected adjacent each side of the roof beam and foldable out therefrom, such that the roof panels swing outwards and upwards on opposite sides of the said roof beam; and a pair of floor panels, one foldably connected adjacent each side of the floor beam and foldable out therefrom, such that the floor panels swing outwards and downwards on opposite sides of the said floor beam, wherein the module is moveable between a folded configuration, in which the foldable wall panels, roof panels and floor panels are stowed at least one of partially within and substantially adjacent the central core, and a second erected configuration, in which the wall panels are outwardly folded from the central core such that the side walls extend from the two opposing fixed walls and the end walls extend between the respective side walls, the floor panels are outwardly folded from the central core so as to extend from opposing sides of the central floor portion and the roof panels are outwardly folded from the central core so as to extend from opposing sides of the central roof portion, wherein in the second erected condition leading edges of the roof panels are positioned inside and no higher than tops of the end wall panels.

DETAILED DESCRIPTION

Figure 2:
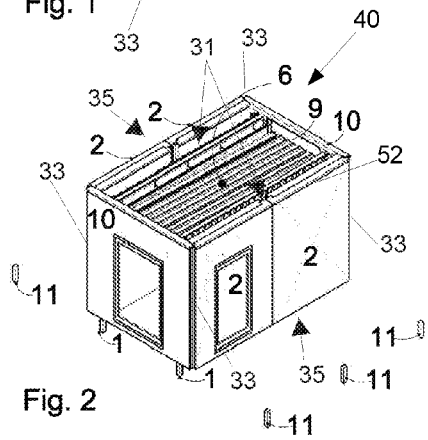
FIG. 2 is a perspective view of a complete collapsed module having a core in accordance with FIG. 1.
Figure 5:
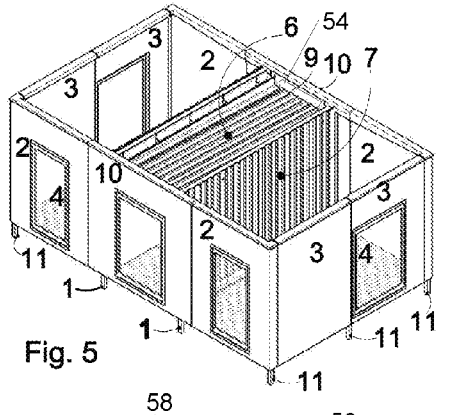
FIG. 5 is a perspective view of the module of FIG. 2 with all sides and floor fully unfolded.
Figure 6:
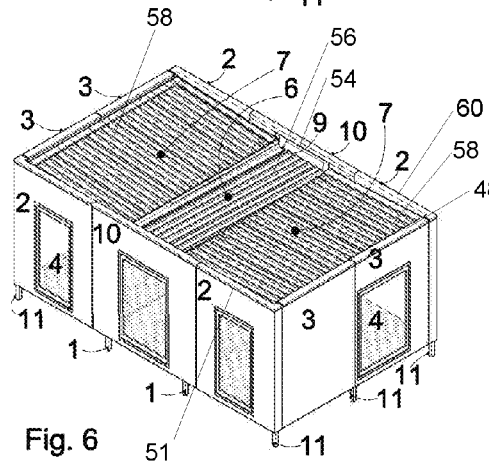
FIG. 6 is a perspective view of the module of FIG. 2 with all sides, floor and roof unfolded.
Figure 7:
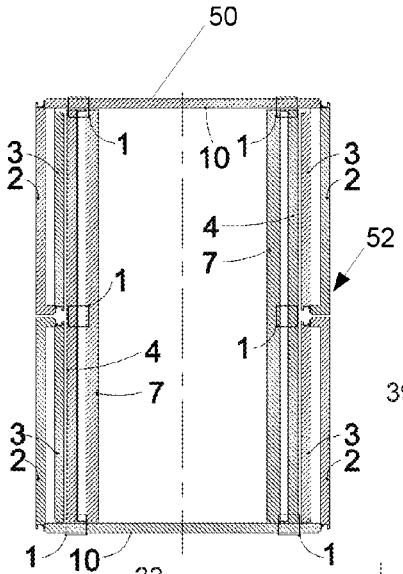
FIG. 7 is a horizontal mid sectional view through the module of FIG. 2 whilst collapsed.
Figure 8:
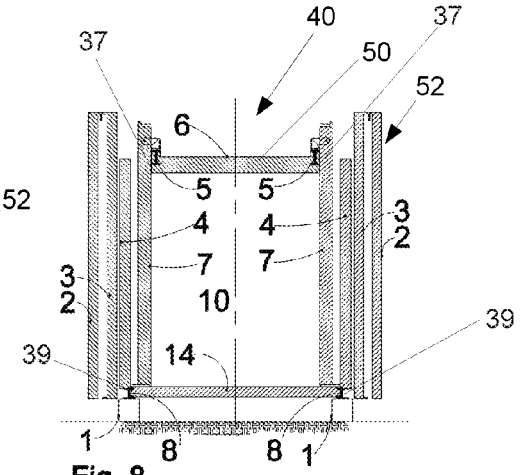
FIG. 8 is a vertical mid sectional view through the module of FIG. 2 whilst collapsed.

Referring to FIGS. 2-10, there is shown a standard prefabricated foldable building module 40 which is configured to expand from a first folded configuration as depicted in FIGS. 2, 7 and 8 to a second erected dwelling configuration as depicted in FIG. 6 via the intermediary steps and configurations depicted in FIGS. 3-5 and 9 and 10. Reversal of the erection steps depicted in sequential order at FIGS. 2-6 permits, after the desired length of use, contraction/collapsing of the standard prefabricated building module back to the first folded configuration of FIGS. 2, 7 and 8. The module 40 is so designed, that after re-folding it is then capable of transportation to another site, where it can be re-erected and re-used and this process may occur on multiple occasions.

The prefabricated, foldable building module 40 includes a central core 50, including a central roof portion 6, a central floor portion 14 and two opposing fixed walls 10 extending between the central roof portion 6 and the central floor portion 14.

The module 40 includes a plurality of foldable wall panels 52, support by the central core 50, including side wall panels 2 each foldably connected to one of the opposing fixed walls 10 and foldable out therefrom and end wall panels 3 each foldably connected to one of the side wall panels 2 and foldable out therefrom.

The module 40 further includes folding roof panels 7 and floor panels 4 supported by the central core 50. The roof panels 7 are each being foldably connected to the central roof portion 6 and foldable out therefrom such that the roof panels 7 swing outwards and upwards on opposite sides of the central core 50. The foldably floor panels 4 are connected to the central floor portion 2 and foldable out therefrom such that the floor panels 4 swing outwards and downwards on opposite sides of the central core 50. As may be best appreciated from FIGS. 1, 2 and, FIG. 8 in combination with FIG. 9, the central roof portion 6 and central floor portion 7 are each relatively narrower in plan form than the two opposing fixed walls 10 so as to define recesses 31 at opposing sides 35 of the central core 50 between ends 33 of the two opposing fixed walls 10 and side edges 37, 39 of the respective central roof and floor portions 6, 7. The recesses 31 provide sufficient depth such that the roof panels 7, the floor panels 4 and at least one of the plurality of foldable wall panels 52 are received by the recesses 31 in the folded configuration. It is noted that in this example, the end wall panels 3 are wholly received by the recesses 31 and the side wall panels 2 span between the ends 33 of the opposing fixed walls 10 and enclose the recesses 31 in the folded configuration. It is also noted the central floor portion 7 is relatively wider in plan form than the central roof portion 6 such that in the folded configuration the roof panels 7 are located within the recesses 31 inwardly of the floor panels 4.

The module 40 is moveable between, the first folded configuration, in which the foldable wall panels 52, roof panels 7 and floor panels 4 are stowed at least one of partially within and substantially adjacent the central core 50, as is shown in FIG. 2, and the second erected configuration, in which the wall panels 52 are outwardly folded from the central core 50 such that the side walls 2 extend from the two opposing fixed walls 10 and the end walls 3 extend between the respective side walls 2, the floor panels 4 are outwardly folded from the central core 50 so as to extend from opposing sides of the central floor portion 14 and the roof panels 7 are outwardly folded from the central core 50 so as to extend from opposing sides of the central roof portion 50, as is shown in FIG. 6.

Figure 10:
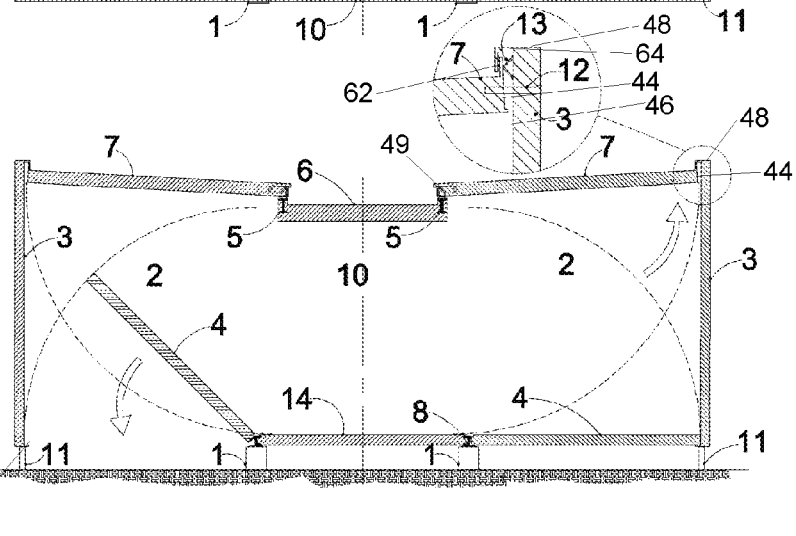
FIG. 10 is a vertical mid sectional view through the module of FIG. 9 during unfolding of roof and floor.
Figure 12:
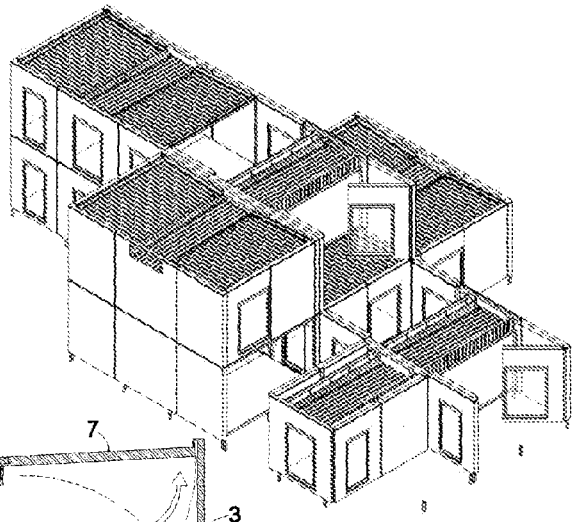
FIG. 12 is a perspective view of multiple assembled modules some of the type depicted in FIG. 2 joined to form a larger two storey building.

As is best shown in FIG. 10, in the erected condition, the central roof portion 6 is recessed relative to tops 48 of the end wall panels 3 and leading edges 44 of the roof panels 7 are positioned below and inside the tops 48 of the end wall panels 3 such that the roof panels 7 slope downwardly toward the central roof portion 6. In the erected condition, foldably connected edges 49 of the roof panels 7 are at least partially elevated relative to the central roof portion 6 so as to direct water captured by the roof panels 7 to the central roof portion 6. As is best shown in FIG. 6, the side walls 2 and the end walls 3 are relatively higher than the roof panels 7 so as to form a parapet 60 above the roof panels 7 which allows the modules 40 to be stackable. The stacking of the modules is best shown in FIG. 12.

Figure 1:
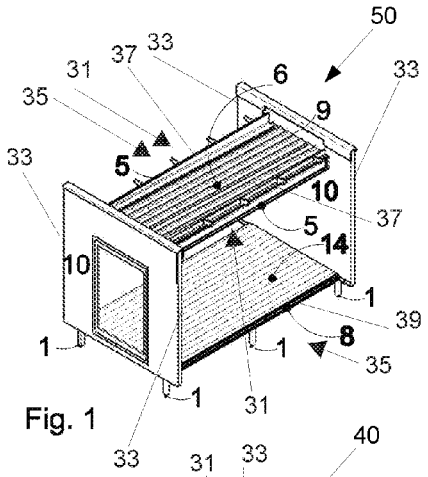
FIG. 1 is a perspective view of the central core of a standard module in accordance with the first aspect of the present invention.
Figure 4:
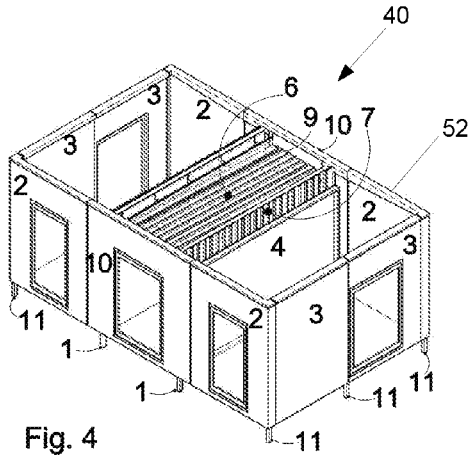
FIG. 4 is a perspective view of the module of FIG. 2 with all walls fully unfolded.
Figure 3:
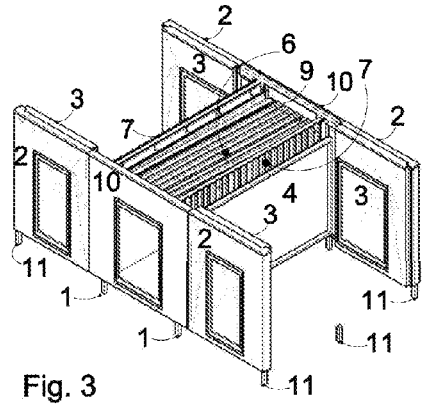
FIG. 3 is a perspective view of the module of FIG. 2 with two opposing side walls fully unfolded.
Figure 9:
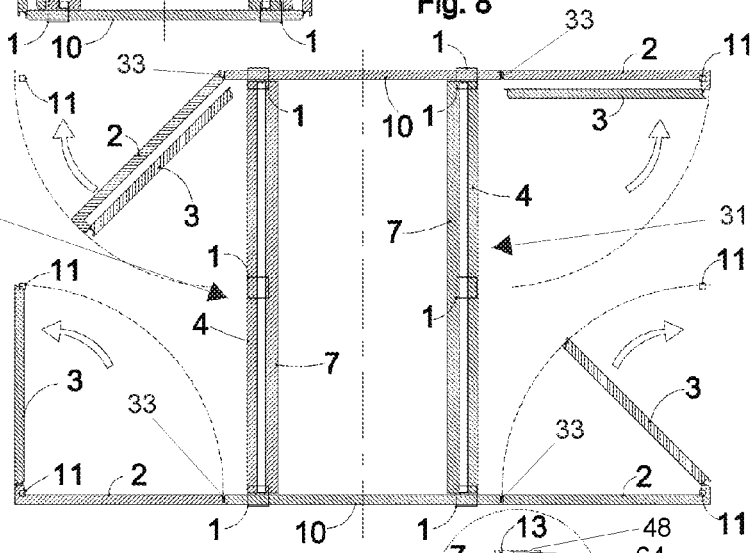
FIG. 9 is a horizontal mid sectional view through the module of FIG. 9 during unfolding of walls.

In use, the module 40 arrives at the intended erection site via truck or trailer (not shown). The module 40 is then moved into place over pre-prepared in/on ground middle support posts 1. The lower extremities of opposing fixed walls 10 and floor beams 8 are then fixed to the middle support posts 1 as best depicted in FIGS. 1 and 8. As best depicted in FIGS. 2, 3 and 9 the side wall panels 2 then swing out from each side of each fixed wall 10 and lock into the pre-installed, in-ground perimeter support posts 11 in final positions co-extensive with the fixed walls 10 upon which they are foldably connected. Subsequently in turn and as best viewed in FIGS. 3, 4 and 9, the end walls 3 swing out at right angles from the leading edge of the side walls 2 and lock into position above the remaining pre-positioned peripheral support posts 11.

Following the above steps and as best viewed in FIGS. 4, 5, 8 and 10, the floor panels 4 swing down from the floor beams 8 and are supported by plates 42 (shown in FIG. 10) at the base of the walls 52 as best depicted in FIGS. 5, 6, 8 and 10. Roof panels 7 are then swung up from their respective roof beams 5 and are fixed to the walls via substantially horizontal pins 12 through the upper extremities of end walls 3 as best viewed in FIG. 10, or a D-ring clip system 13, also best depicted in FIG. 10. The leading edges 44 of the roof panels 7 are secured, by the pins 12 or clip 13, to an inside face 46 of the end wall 3 so as to be positioned just below and inside the tops 48 of the end walls 3.

Figure 11:
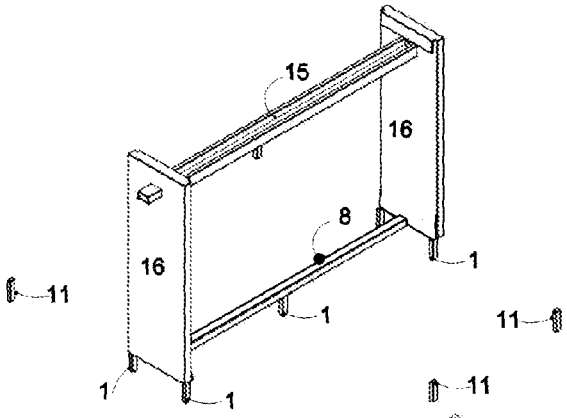
FIG. 11 is a perspective view of a central core in accordance with the second aspect of the present invention.

FIG. 11 illustrates a more basic aspect of the standard module in which the central core is shown as a narrower element with only one roof beam 15 and only one floor beam 8 and no defined central roof portion or central floor portion. Accordingly, the fixed volume of the central core is reduced and the roof panels (not shown) are foldably attached to and swing up from each side of the roof beam 15 and the floor panels (not shown) are foldably attached to and swing down from each side of the floor beam 8. The roof beam 15, may be configured in the form of a central roof gutter or channel allowing rainwater to be collected and diverted to either, or both sides of the central core, when the roof panels are in butterfly style configuration.

Although the embodiment of the more basic module employs the same opening and closing sequences as the standard module FIGS. 1-10, this aspect serves better to illustrate the flexibility of the invention in that in its erected form (not shown) the module may be fully enclosed or only partly enclosed, dependent upon the relative dimensions of its comprising elements, and the roof slopes and shapes may vary, between horizontal, butterfly or gable, dependent upon the arc of swing of the roof panels (not shown) when they unfold into the open position. The flexibility demonstrated by this aspect of the module can also be applied to both the standard module, FIGS. 1-10 and the stretched version of the standard module, FIGS. 14A, 14B and 14C (referred to below).

Figure 14A:
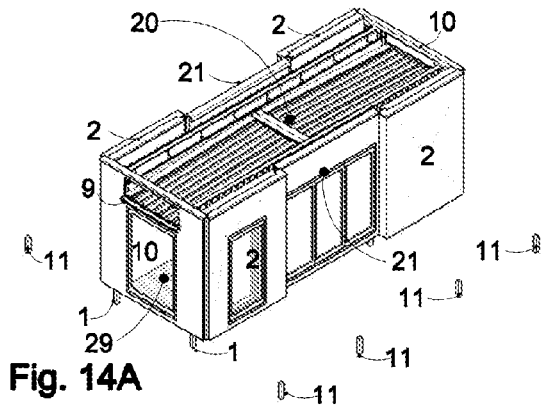
FIG. 14A is a perspective view of a complete collapsed module with the core, floors and roofs stretched to form a longer rectangular form.
Figure 14B:
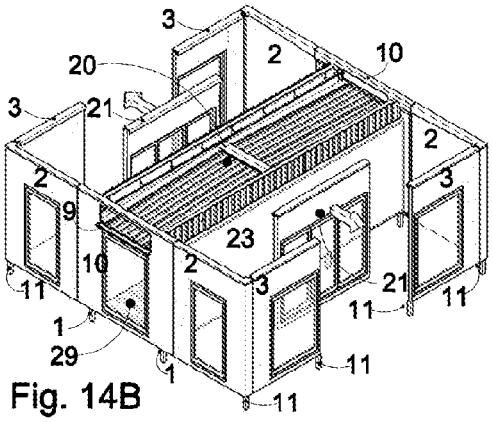
FIG. 14B is a perspective view of the module of FIG. 14A after unfolding of walls, with infill wall sections being positioned.
Figure 14C:
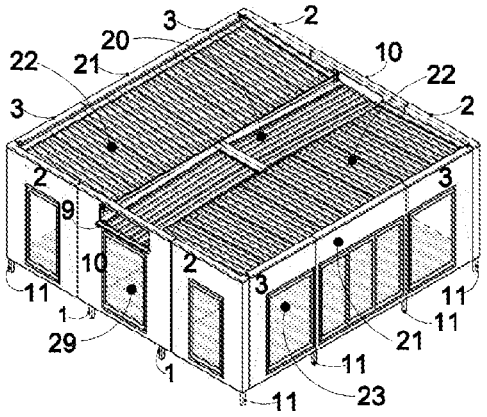
FIG. 14C is a perspective view of the module of FIG. 14A with all sides, floor and roof unfolded and positioned.

Standard modules FIGS. 1-10, can be stretched to form larger buildings as depicted in FIGS. 14A, 14B and 14C, but certain modifications to the standard module need be made. The central core is stretched resulting in a longer central floor portion 29 with longer floor beams and a longer central roof portion 20, with longer roof beams. Roof panels 22 and floor panels 23 are stretched laterally to correspond with the longer central core, resulting in a greater sheltered floor space when the module in open configuration. After the foldable wall panels 2 and 3 are unfolded into open position, an additional infill wall panel 21 is placed in the gap between the leading edges of the end well panels 3, FIG. 14B, on each side of the structure to complete the perimeter wall. The floor panels 23 and the roof panels 22 are then swung into the open position. While in folded configuration the additional infill wall panels 21 are housed, one adjacent each side of the central core on the outside of the roof panels 22 and floor panels 23 and in the gap between the foldable wall panels, 2 and 3, as best viewed in FIG. 14A.

The module may have a steel, timber or other frame and can be finished in a variety of external claddings and internal lining options. There are a number of different door and window size and location options to suit different applications.

As illustrated in FIGS. 1 to 10, the standard module 40 has the central roof portion 6 at the top of the central core 50 that falls directly to a gutter 54 at one or both sides of the central core. The side roof panels 7 fall toward the central roof portion 6. A single down pipe (not shown) on one or both fixed walls 10, may be used to exhaust the end wall gutter or gutters 54. The need for eaves or additional gutters or the piping of water from the edges of the building is therefore eliminated. The central roof portion 6 also includes channels 56, shown for example in FIG. 6, which extend between the opposing fixed side walls 10. These channels 56 (which also may be considered gutters) assist to direct water from the roof panels 7 to the one or more gutters 54. The roof panels 7 also include channels 58 which are oriented between the end walls 3 and the central roof portion 6 to direct water to the central roof portion 6.

Standard modules can easily be joined together side by side or end to end to create larger shelters or dwellings as depicted in FIG. 12, due to the absence of eaves external gutters.

Figure 13A:
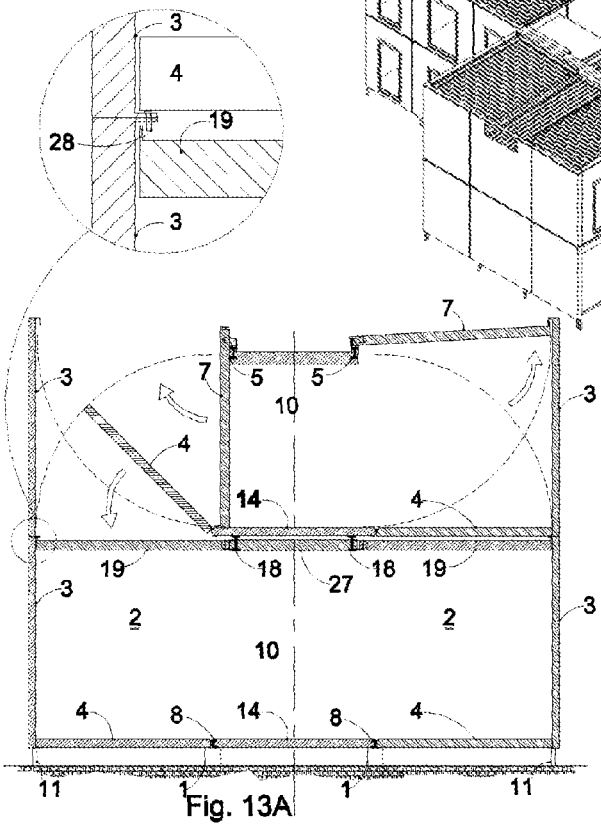
FIG. 13A is a vertical mid sectional view through the module of FIG. 10 atop a revised module suitable for ground floor and intermediate floor use in multiple storey building.
Figure 13B:
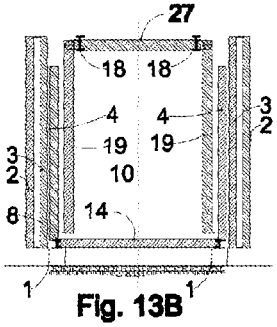
FIG. 13B is a vertical mid sectional view through the complete collapsed revised module suitable for ground floor and intermediate floor use in multiple storey building.

Standard modules can also be stacked to form multi-storey buildings as depicted in FIGS. 12, 13A and 13B and certain modifications to the standard module above described may be made. Firstly, as the lower floor module need no longer have a roof designed to catch and dispose of rainwater the roof beams 18 and the central roof portion 27 are raised in position relative to fixed side walls 10 as compared with beams 5 designed for single storey construction. This results in no fall on the folding roof panels 19 foldably connected to beams 18, when erected and therefore greater headroom in the central portions of the ground and intermediate floor modules beneath beams 18. Vertical pins 28 fix plates attached to the lower extremities of the upper walls to plates attached to the upper extremities of the lower walls as depicted in FIG. 13A. It will also be appreciated that beams 18 will need to be more substantial than standard roof beams 5, as the upper level floors may only be supported around their peripheries rather than augmentation by in/on ground support posts 1. It will also be appreciated that the configuration whereby the roofs and floors lie inside the erected walls results in a clean external look to the multiple storey walls.

Figure 15A:
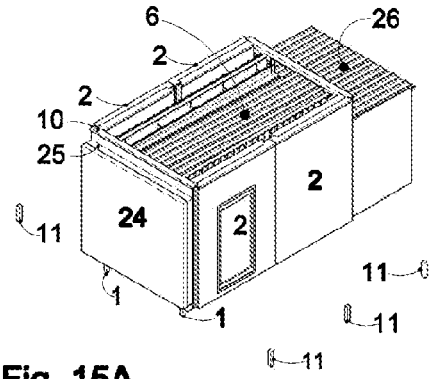
FIG. 15A is a perspective view of a complete collapsed module of FIG. 2 with additional floor and roof panels attached to one fixed wall of the central core and an additional room attached to the opposite fixed wall of the central core.

The central core 50 of the standard module depicted in FIG. 1, provides a fixed central floor portion 14, which may be used for location of bathroom, kitchen and laundry fixtures (none shown) that require plumbing and electrical wiring (not shown). A wider version of the central core 50 is also possible and provides an even more spacious central floor portion, where after location of the aforementioned fixtures, surplus volume, if available, could be used to store unfixed furniture and building materials whilst the module is in folded configuration. Alternatively, a volumetric addition, 26 of FIG. 15A can be attached to one or both fixed wall ends of the module providing additional internal space.

The central roof portion 6, may be fabricated from steel, aluminium or other suitable roof sheeting material, as may be the two main folding roof panels. Central roof portion 6 is desirably substantially lower than the two adjacent folding roof panels 7 and would desirably have a fall (say 3 degrees) perpendicular to the fall on the two adjacent folding roof panels, falling to a gutter 54 and downpipe (not shown) on one or both of the fixed walls 10. Therefore water will fall from the sky onto one of the two folding roof panels, it will then fall along the folding roof panel 7 and onto the fixed central roof portion 6. From there the water will be guided perpendicularly across the central roof portion 6 and into the gutter 54 or a sump (not shown) and downpipe (not shown) on the outside of one or both of the fixed walls 10. As an alternative method of dealing with rainwater runoff from the roof panels, gutters may be attached along each of the upturned edges of the central roof portion adjacent to the foldably connected edges of the roof panels 49, thus catching the water flow before it reaches the central roof portion and guiding it along the gutters into the said sump (not shown) and downpipe (not shown) on the outside of one or both fixed walls 10.

It will be appreciated that the simple construction sequence of the current invention has the walls on the outside of the collapsed module. Wall panels fold out first so that when the roof and floor panels follow they are wholly contained by the walls. This allows the roof and floor to stabilize the walls and also offers the advantage of using the already erected wall panels to support a simple winch or pulley device to assist in raising the roof panels and lowering the floor panels. Having the walls on the outside of the roof and floor also allows for continuity of material over the entire perimeter of the building. The invention avoids the appearance of floor and roof edges from outside the building and simplifies weather protection of floors. Roof and wall panel junctions must naturally be effectively waterproofed in accordance with existing technology.

During the erection process there is no requirement for temporary support of roof panels while wall panels are swung into the open position. This simpler and safer opening sequence requires minimal lifting equipment, time, manpower and resources on site.

There is no reliance on track and/or wheel systems to position the end walls or requirement for the end walls to be lifted from floor panels or dropped from temporarily supported roof panels as in some prior art systems. Accordingly, there is provided an erection technique, which is simpler, safer and more effective.

The elimination of cave overhangs and most peripheral guttering allows for simple connection of units. This means that any number of units can be positioned and joined together to form a dwelling of any size. Due to the compact size and weight of each unit, only smaller lifting devices are required such as folk lifts or integrated cranes on haulage trucks that deliver the modules.

The overall design and opening sequence of the prefabricated module above described allows for a large floor area and enclosed volume when open, compared to the collapsed volume.

As the bathroom and kitchen areas are preferably central to the module the ceiling level raises towards the external walls where the main living spaces are. The height is hence lower over the utility areas of the bathrooms and kitchens. This provides a more pleasant spacial experience while using the building. It also provides more opportunity for window opening positions on the external walls.

The break-up of walls and resulting weight reduction of each panel may allow manual handling by 2 men to swing the foldable wall panels out into erected position and fix individually to post supports. When the foldable wall panels have been secured in open module position they form a solid element from which roof panels can be raised into place and floor panels lowered.

The present invention results in an aesthetically pleasing building as foldable wall panels fold out before the roof and the floor panels resulting in the roof and floor being contained within the walls, creating a simple boxlike appearance. The top of the walls form a parapet above the roof.

As depicted in the blown up detail of FIG. 10, upturns 62 at the edges 44 of the roof panels may fit up into and inside extruded downward facing capping sleeves 64 running along the tops 48, 51 of the external walls 2, 3 to form a weather proofing wall to roof detail.

A variety of different support systems can be used depending on the application of the module. The base of the wall panels fix to support posts to enable structural support and integrity. These support posts can be either permanent or temporary depending on the application of the module. If permanent, the support posts can be set into concrete footings or screw pile type footings can be used. When the wall panels are open the plates at the base sit on and fix to the support posts. Shimming on site between the posts and wall panels accommodates any site tolerances.

The roof 7 and floor panels 4 preferably fix to the wall panels 52 when open to provide structural support for the roof and floor as well as structural integrity to the module 40 as a whole. The floor panels sit on and fix to plates at the base of the wall panels. The roof panels have plates or upturns 62 along the outside edge that fix to the tops 48 of the wall panels 3 in a variety of different ways including bolt fix 13 or hang fix to welded steel D-rings 13.

If modules are joined end to end as in FIG. 12, the end wall panels at the interface of one module to another can be omitted. For example: if three modules are joined end to end then the first module may have 2 end wall panels omitted, the middle module may have all 4 end wall panels omitted and the last module may have 2 end well panels omitted. The modules may also be connected along the side walls. In this case the side wall panels are retained but with large structural openings which correspond in each of the adjoining modules. Offset side connection of modules is also achievable.

Where the end wall panels are omitted the outside edges of opposing roof panels meet at the interface of the modules. In this case beams (not shown) at the roof panel edge will need to be increased in size to transfer the load to the side walls and a capping needs to be placed to waterproof the junction between the two upturned roof edges.

Additional modules can be joined together on top of ground engaging modules resulting in multi-level buildings, FIGS. 12 and 13A. A crane would be required for this.

It will be appreciated that window and door openings can be positioned in a multitude of locations in any wall of the module. Roof lights can be placed in roof panels. Voids for stairs can be placed in floor panels.

Figure 15B:
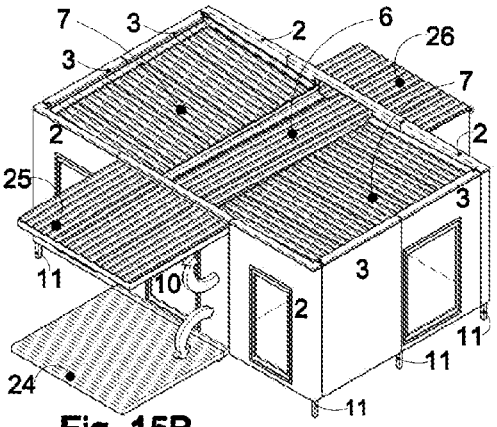
FIG. 15B is a perspective view of the module of FIG. 15A with the additional floor and roof panels unfolded.

As can be seen the design of the module lends itself to a versatile range of design options and additions, as illustrated in FIG. 15B depicting the addition of an extra floor panel 24, horizontally foldably connected to the base of one of the fixed walls 10. In closed configuration this panel lies adjacent to fixed wall 10, but when opened swings down to provide an external floor area. Similarly, an additional roof panel 25, may be horizontally foldably connected to the top of one of the fixed walls 10 and lies adjacent to that wall when closed, but when opened swings up until substantially at right angles to said fixed wall, thus providing an external roof shelter.

Figure 16:
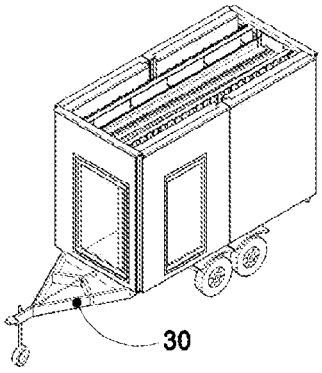
FIG. 16 is a perspective view of a complete collapsed module of FIG. 2 fixed to the tray of a wheeled trailer.

A road worthy trailer with wheels 30 can be added to the base of the module as depicted in FIG. 16, to enable the module to be fully mobile and road worthy when in a contracted transportable state. It will be appreciated that many other embodiments of the present invention may be devised without departing from the scope and intendment thereof.

Throughout this specification and the claims which follow, unless the context requires otherwise, the word "comprise", and variations such as "comprises" and "comprising", will be understood to imply the inclusion of a stated integer or step or group of integers or steps but not the exclusion of any other integer or step or group of integers or steps.

The reference in this specification to any known matter or any prior publication is not, and should not be taken to be, an acknowledgment or admission or suggestion that the known matter or prior art publication forms part of the common general knowledge in the field to which this specification relates.

While specific examples of the invention have been described, it will be understood that the invention extends to alternative combinations of the features disclosed or evident from the disclosure provided herein.

Many and various modifications will be apparent to those skilled in the art without departing from the scope of the invention disclosed or evident from the disclosure provided herein.

The invention claimed is:

1. A prefabricated, foldable building module, including:

a central core, including a central roof portion, a central floor portion and two opposing fixed walls extending between the central roof portion and the central floor portion;

a plurality of foldable wall panels including side wall panels each foldably connected to one of the opposing fixed walls and foldable out therefrom and end wall panels each foldably connected to one of the side wall panels and foldable out therefrom;

roof panels, each being foldably connected to the central roof portion and foldable out therefrom such that the roof panels swing outwards and upwards on opposite sides of the central core;

floor panels, each being foldably connected to the central floor portion and foldable out therefrom such that the floor panels swing outwards and downwards on opposite sides of the central core, wherein the module is moveable between, a folded configuration, in which the foldable wall panels, roof panels and floor panels are stowed at least one of partially within and substantially adjacent the central core, and an erected configuration, in which the wall panels are outwardly folded from the central core such that the side walls extend from the two opposing fixed walls and the end walls extend between the respective side walls, the floor panels are outwardly folded from the central core so as to extend from opposing sides of the central floor portion and the roof panels are outwardly folded from the central core so as to extend from opposing sides of the central roof portion, wherein in the erected configuration, the central roof portion is recessed relative to tops of the end wall panels and leading edges of the roof panels are positioned inside of and below the tops of the end wall panels such that the roof panels slope downwardly toward the central roof portion, and wherein the central roof and floor portions are each narrower in plan form than the two opposing fixed walls so as to define recesses between ends of the two opposing fixed walls and side edges of the respective central roof and floor portions, the recesses providing a depth such that the roof panels, floor panels and at least one of the plurality of foldable wall panels are received by the recesses in the folded configuration.

2. The prefabricated, foldable building module according to claim 1, wherein, in the erected configuration, the side walls and the end walls are higher than the roof panels so as to form a parapet above the roof panels.

3. The prefabricated, foldable building module according to claim 2, wherein the parapet is configured to allow multiples of the module to be joined together, one on top of the other, to form multi-level structures.

4. The prefabricated, foldable building module according to claim 1, wherein, in the erected configuration, the leading edges of the roof panels are coupled to the end wall panels below the tops of the end wall panels.

5. The prefabricated, foldable building module according to claim 1, wherein in the erected configuration, leading edges of the roof panels are connected by at least one of a pin or clip to the end wall panels below and inside the tops of the end wall panels.

6. The prefabricated, foldable building module according to claim 1, wherein, in the erected configuration, foldably connected edges of the roof panels are at least partially elevated relative to the central roof portion so as to direct water captured by the roof panels to the central roof portion.

7. The prefabricated, foldable building module, according to claim 1, wherein the roof panels each include an upturn at the respective leading edges thereof and the end wall panels each include a corresponding extruded capping sleeve running along an inside top thereof into which the corresponding upturn fits in the erected configuration so as to be weatherproof.

8. The prefabricated, foldable building module, according to claim 1, wherein the central roof portion includes two beams extending along opposing sides of the central roof portion, the roof panels each being connected to a respective one of the two beams.

9. The prefabricated, foldable building module according to claim 1, wherein the central roof portion includes a gutter for directing water captured by the roof panels.

10. The prefabricated, foldable building module according to claim 1 wherein the central roof portion is arranged to direct water toward at least one of the opposing fixed walls of the central core.

11. The prefabricated, foldable building module according to claim 1, wherein the roof panels and the floor panels are arranged to swing into the erected configuration after the foldable wall panels have unfolded, such that the roof panels and the floor panels are wholly enclosed within the foldable wall panels, and outer edges of the floor and roof panels are supported directly or indirectly by the foldable wall panels.

12. The prefabricated, foldable building module according to claim 1, wherein the roof panels are arranged to swing into the erected configuration after the foldable wall panels have unfolded, such that the roof panels do not require any additional support whilst the foldable wall panels unfold into the erected configuration.

13. The prefabricated, foldable building module according to claim 1, wherein the end walls present a substantially flush outer surface so as to allow abutment with other modules.

14. The prefabricated, foldable building module according to claim 1, wherein the side walls and the end walls each have substantially flush outer surfaces arranged such that multiples of said module in the erected configuration may be joined together at any of the side walls and end walls to create larger structures in a variety of configurations.

15. A prefabricated, foldable building module according to claim 1, wherein the side walls and the end walls have substantially flush outer surfaces such that in the erected configuration multiples of the module may be joined together, side by side, either fully interfaced or partly offset, and where corresponding openings may be made at the interface between modules.

16. The prefabricated, foldable building module according to claim 1, wherein a further module in the erected configuration may be joined together with the module, end on end, and where at an interface of the module and the further module, an end wall panel of the further module may be omitted.

17. The prefabricated, foldable building module according to claim 1, wherein in the folded configuration, the foldable wall panels, the roof panels, and the floor panels lie substantially co-planar to each other adjacent open sides of the central core such that the module presents as a rectangular shaped box structure.

18. The prefabricated, foldable building module according to claim 1, further including associated infill panels and wherein in the erected configuration the infill panels are fitted between the end wall panels.

19. The prefabricated, foldable building module according to claim 1, wherein, the central floor portion is wider in plan form than the central roof portion such that in the folded configuration the roof panels are located within the recesses inwardly of the floor panels.

20. A method of assembling a building from a prefabricated, foldable building module, the method including the steps of:

folding wall panels connected to opposing fixed end walls of a central core of the module outwardly from within recesses on opposing sides of the central core to form outer walls of the building, the recesses being provided between ends of the opposing fixed end walls and side edges of a respective central roof and floor portions of the central core, the central roof and floor portions being each narrower in plan form than the fixed end walls, and the wall panels including side wall panels foldably connected to the ends of the opposing fixed end walls of the central core and end wall panels foldably connected to the side wall panels;

folding floor panels connected to the central floor portion outwardly from the recesses and downwardly relative to the central floor portion of the central core so as to form a floor between the outer walls of the building; and folding roof panels connected to the central roof portion outwardly from within the recesses and upwardly relative to the central roof portion supported by the fixed walls of the central core so as to form a roof between the outer walls of the building over the floor, the roof panels being supported by and positioned inside of and below tops of the end wall panels such that the roof panels slope downwardly toward the roof portion.

21. The method according to claim 20, further including the step of:

securing leading edges of the folding roof panels to inside faces of the end wall panels by at least one of a clip and pin fitted between the end wall panels and the folding roof panels.

* * * * *